US005845434A

United States Patent [19]

Hayashi

[11] Patent Number: 5,845,434

[45] Date of Patent: Dec. 8, 1998

[54] THEATRE

[76] Inventor: Masahiko Hayashi, 12-22, Tsurumaki 3-chome, Setagaya-ku, Tokyo, Japan

[21] Appl. No.: 553,804

[22] Filed: Oct. 23, 1995

[51] Int. Cl.[6] ..... A63G 31/00; E04H 3/22

[52] U.S. Cl. ..... 52/9; 52/8; 52/29; 472/59

[58] Field of Search ..... 52/6, 8, 9, 29, 52/1; 472/59, 60, 136

[56] References Cited

U.S. PATENT DOCUMENTS

| | | | |
|---|---|---|---|
| 2,280,206 | 4/1942 | Waller et al. | 52/6 X |
| 3,545,143 | 12/1970 | Bankston | 52/6 |
| 3,628,829 | 12/1971 | Hellig | 52/8 X |
| 3,668,810 | 6/1972 | Bankston | 52/6 |
| 3,865,430 | 2/1975 | Tanus | 472/60 X |
| 4,686,799 | 8/1987 | Kwake | 52/6 X |
| 4,874,162 | 10/1989 | Trumbull et al. | 472/60 |
| 4,879,849 | 11/1989 | Hollingsworth et al. | 52/6 X |
| 4,885,878 | 12/1989 | Wuu | 52/6 |
| 5,140,790 | 8/1992 | Modglin et al. | 52/80.1 |
| 5,192,247 | 3/1993 | Barr et al. | 472/60 |
| 5,433,670 | 7/1995 | Trumbull | 472/59 X |
| 5,496,220 | 3/1996 | Engstrand | 472/60 |
| 5,611,174 | 3/1997 | Hayashi | 52/6 X |

*Primary Examiner*—Robert Canfield
*Attorney, Agent, or Firm*—Jordan and Hamburg

[57] ABSTRACT

According to the present invention, a multiplicity of compartments are horizontally and vertically arranged, allowing spectators on seats in the compartments to enjoy the view of an image projected on a screen installed outside the compartments and to enjoy the realistic effects, without bothering or being bothered by the neighbors.

12 Claims, 20 Drawing Sheets

1D
9
9
9

THEATRE

BACKGROUND OF THE INVENTION

The present invention relates to a theatre in which an audience or spectators in compartments can view an image projected on a screen outside the compartments.

Conventional image producing facilities showing an image projected on a screen, such as cinemas and planetariums, are all equipped with seats arranged on a flat floor or on a sloping floor.

Since the conventionally installed seats are all together in an area without partitioning, spectators are disturbed by their neighbors' noises while being prohibited from eating, conversing, etc., for fear of bothering the neighbors.

The viewing experience is greatly affected, as the field of view is obstructed particularly by the heads of the spectators who are seated in front.

SUMMARY OF THE INVENTION

The viewing experience is free from the foregoing disadvantages, which allows spectators to eat, converse, etc., without being inhibited by concern for the neighbors, while further allowing the enjoyment of the view of the image on the screen without being obstructed by those sitting in front.

It is a further object of the invention to provide a theatre which projects an image with highly realistic and panoramic effects and which makes spectators feel as if they were integrated into the image.

The present invention is clarified by the following description read in conjunction with the accompanying drawings.

The drawings are illustrative and are not intended to limit the scope of the present invention.

DETAILED DESCRIPTION OF THE INVENTION

Figure 1:
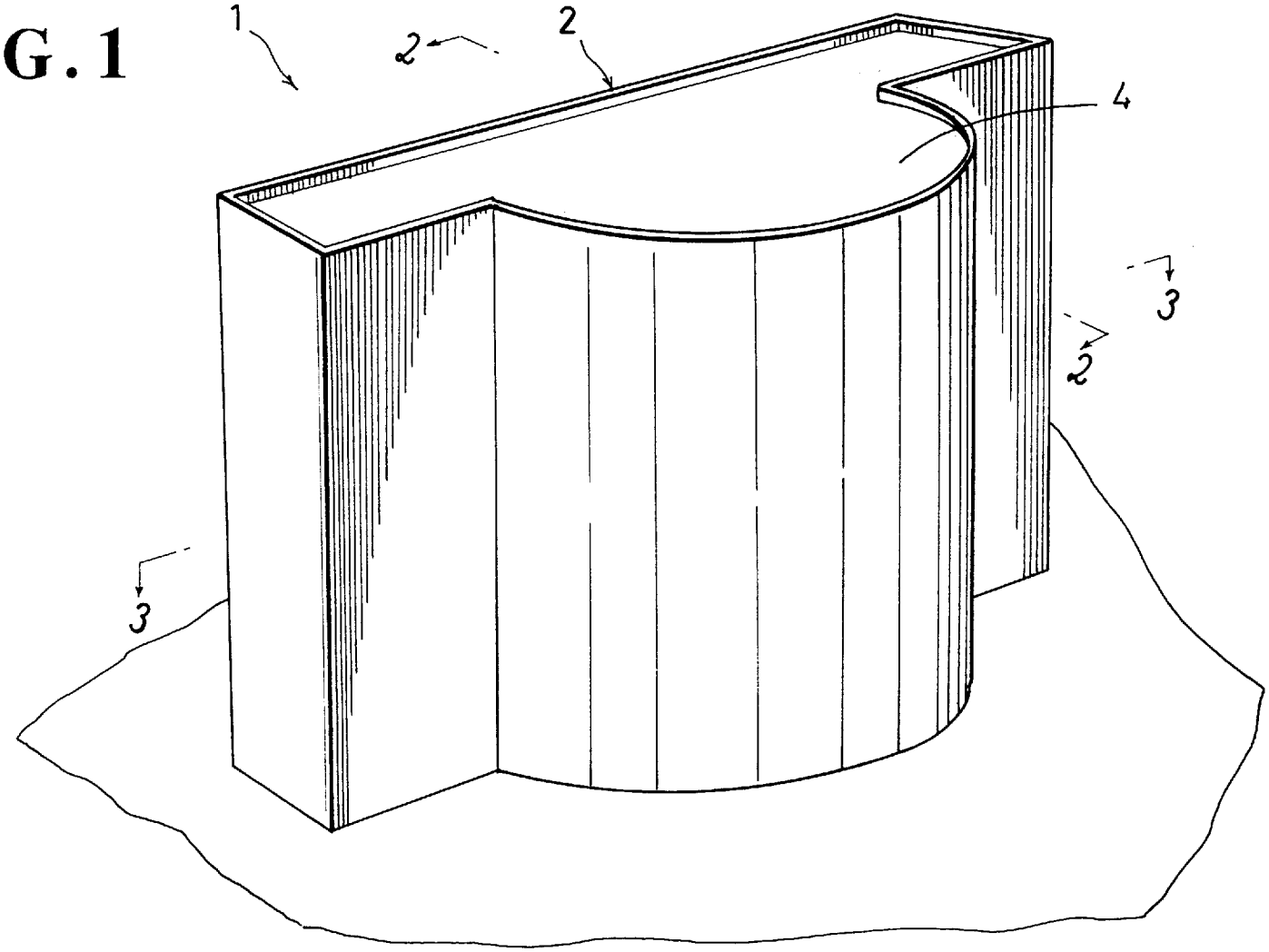
FIG. 1 is a perspective view of the first embodiment of the present invention.
Figure 2:
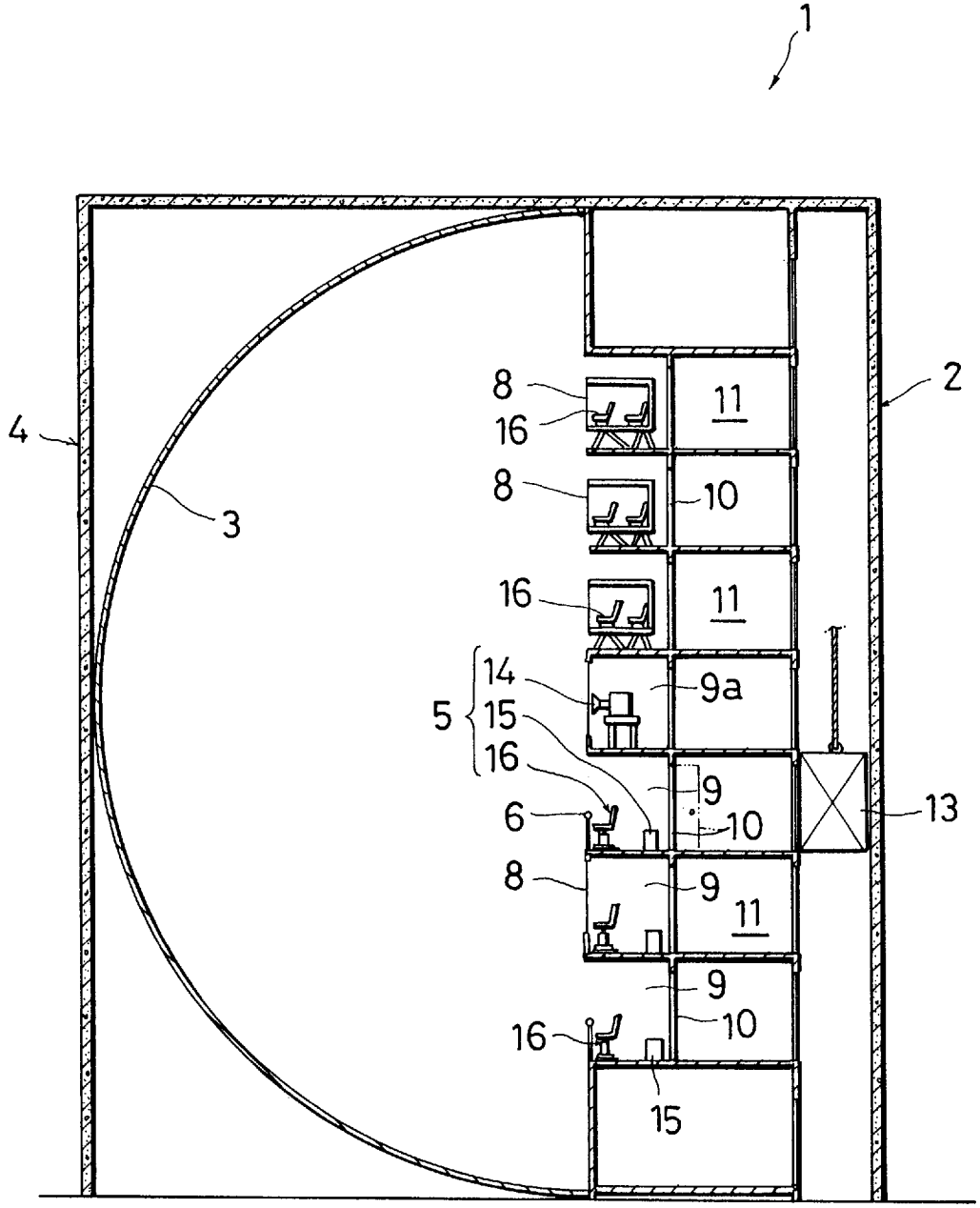
FIG. 2 is a cross-sectional view taken along the line 2—2 of FIG. 1.
Figure 3:
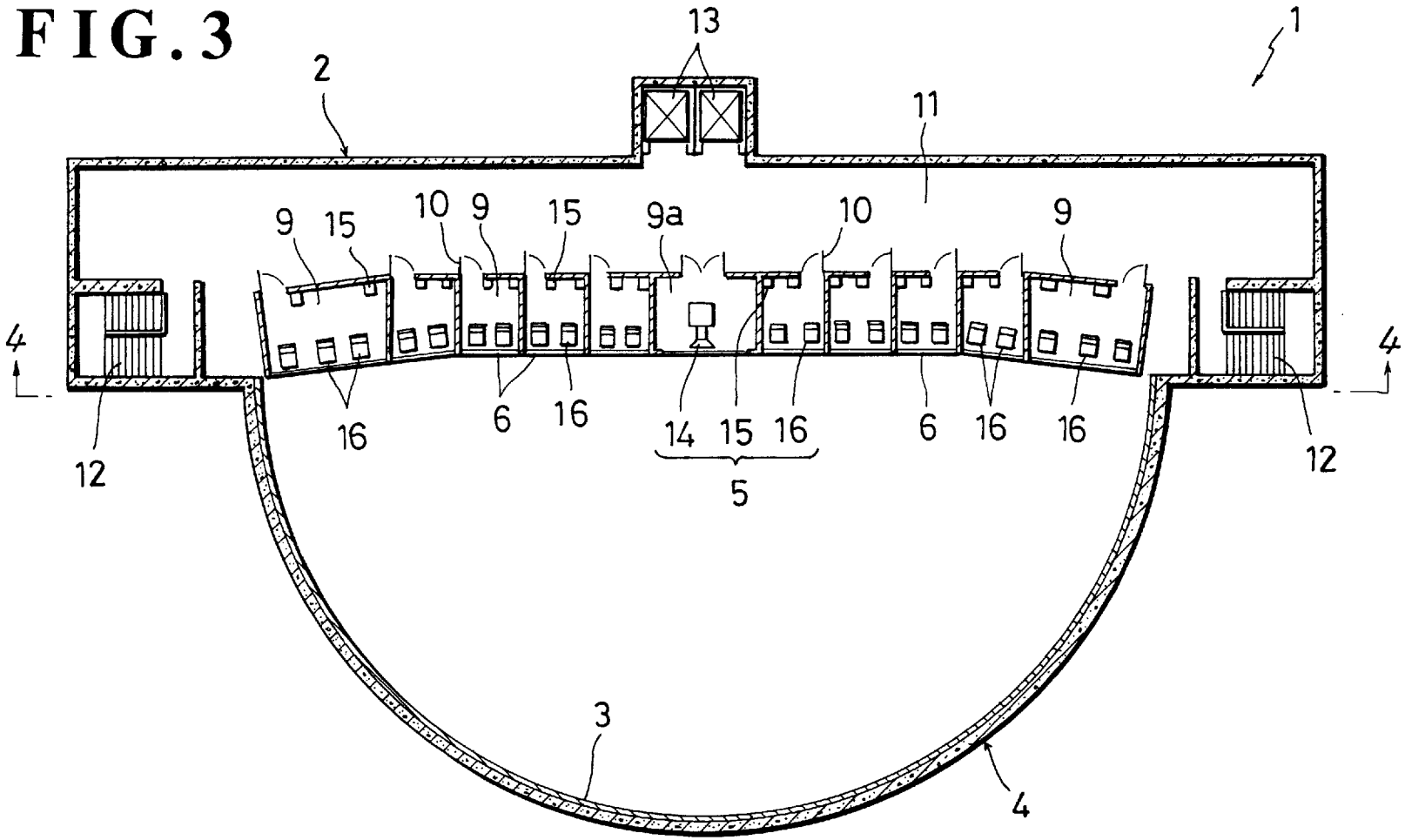
FIG. 3 is a cross-sectional view taken along the line 3—3 of FIG. 1.
Figure 4:
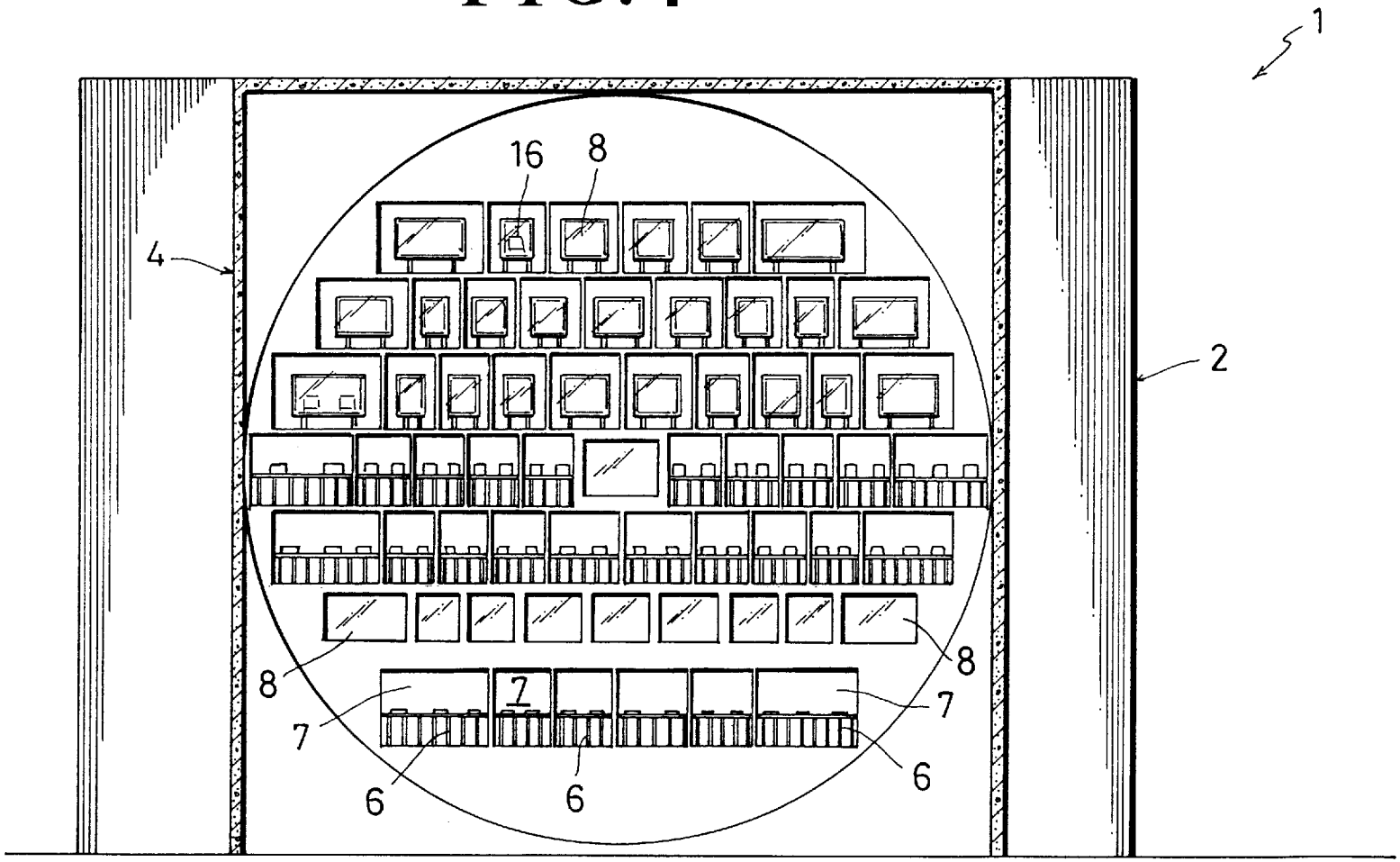
FIG. 4 is a cross-sectional view taken along the line 4—4 of FIG. 3.

Preferred embodiments of the present invention will be described in more detail referring to the accompanying drawings.

FIGS. 1 to 7 illustrate a first embodiment of the present invention represented by theatre 1 comprising: a nine-storied compartment building 2; screen housing 4 covering the front of the the compartment building 2 containing dome-shaped screen 3 capable of being viewed from the compartment building 2; and an image producing system 5 capable of projecting an image on the dome-shaped screen 3.

The compartment building 2 comprises: a plurality of compartments 9 arranged horizontally and vertically in an array, i.e., in a series on each floor, each of which having an opening 7 with fence 6 or window 8 provided in the front thereof; passages 11, provided on each floor, for access to the compartments 9, each through a door 10; stairways 12, 12 connecting both ends of the passages 11; and elevators 13, 13 connecting the passages on the respective floors.

Each floor has a plurality of compartments in the present embodiment, however, the explanation is not limited to such a case, each floor may have only one compartment.

The image producing system 5 comprises: projector 14 mounted in projection booth 9*a* almost in the center of the compartment array and capable of projecting an image on the dome-shaped screen 3; at least one or more loud speakers 15 installed behind or around the dome-shaped screen 3 or allocated to the compartments 9 at any part thereof such as the ceiling, floor, etc., for producing a sound synchronized with the image projected by the projector 14; and oscillating chairs 16 installed in each of the compartments 9 and capable of keeping spectators standing or seated, as synchronized with the image projected by the projector 14.

Figure 5:
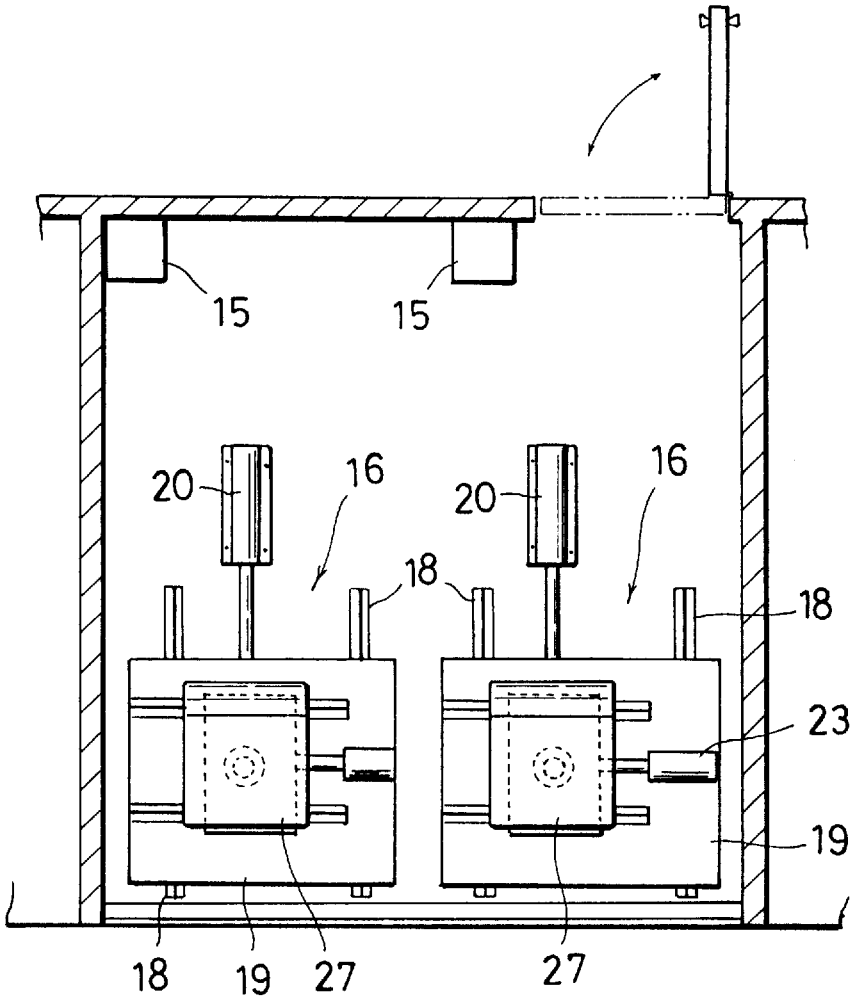
FIG. 5 is a plan view of a compartment according to the first embodiment of the present invention.
Figure 6:
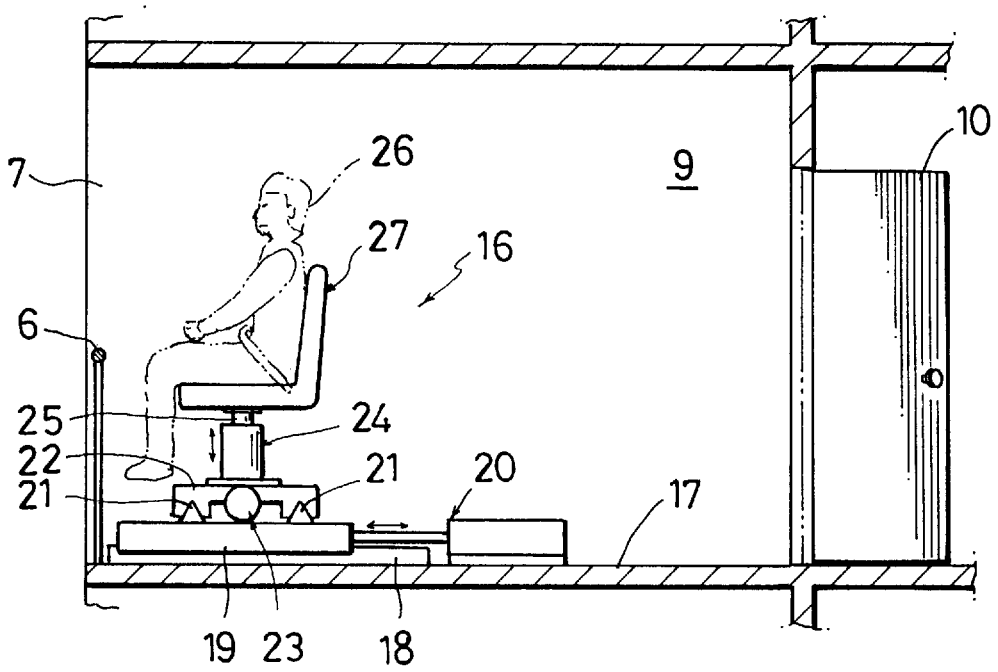
FIG. 6 is a side view of a compartment according to the first embodiment of the present invention.
Figure 7:
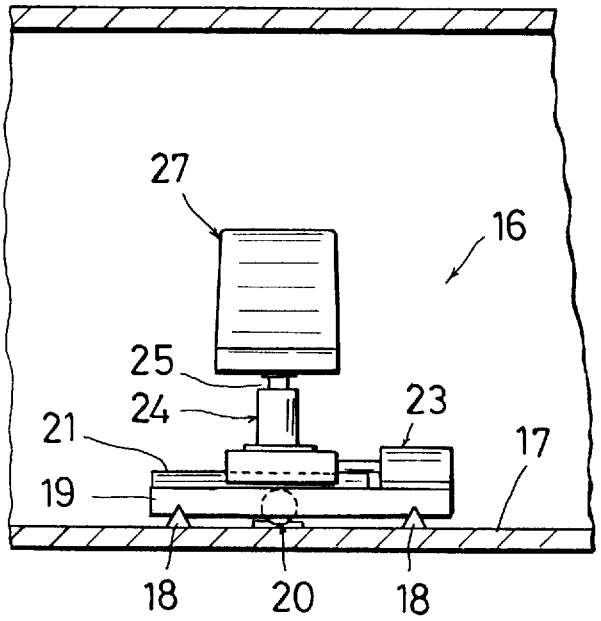
FIG. 7 is an explanatory view of an oscillating chair according to the first embodiment of the present invention.

The oscillating chair 16 comprises, as shown in FIGS. 5 to 7: an X-direction base plate 19 sliding on X-direction guide rails 18, 18 fixed on a floor plate 17; an X-direction cylinder device 20 for sliding hydraulically, pneumatically, etc., the X-direction base plate 19; a Y-direction base plate 22 sliding on Y-direction guide rails 21, 21, which are perpendicular to the sliding direction of the X-direction base plate 19, formed on the top surface of the X- direction base plate 19; a Y-direction cylinder device 23 for sliding hydraulically, pneumatically, etc., the Y-direction base plate 22; a vertical cylinder device 24 vertically expandable pneumatically, hydraulically etc.; and seal 27, capable of seating spectator 26 in the present embodiment, attached on the top of a working shaft 25 of the vertical cylinder device 24.

The oscillating chair 16 is not limited to this structure, but may be replaced with a triaxial or quadriaxial oscillating mechanism now in general use for the same purpose.

Moreover, oscillating chair 16 may be a seat for one person, or may be replaced with a bench for several people, a box containing a fixed chair or a bench or an oscillating cabin.

In theatre 1 of the above construction, elevators 13, 13 and stairways 12, 12 are used to reach a passage 11 on each floor for access to the compartments 9 by opening doors 10.

A spectator 26 in each compartment 9 is seated on a seat 27 of the oscillating chair 16 to watch the image projected by the projector 14 on the dome-shaped screen 3, while the chair 16 oscillates synchronized with an image on the screen, thus producing panoramic and realistic effects.

Other embodiments of the present invention will now be described referring to FIGS. 8 to 21. Throughout the drawings of the embodiments, like components are denoted by like numerals as of the first embodiment and are explained in no more detail.

Figure 8:
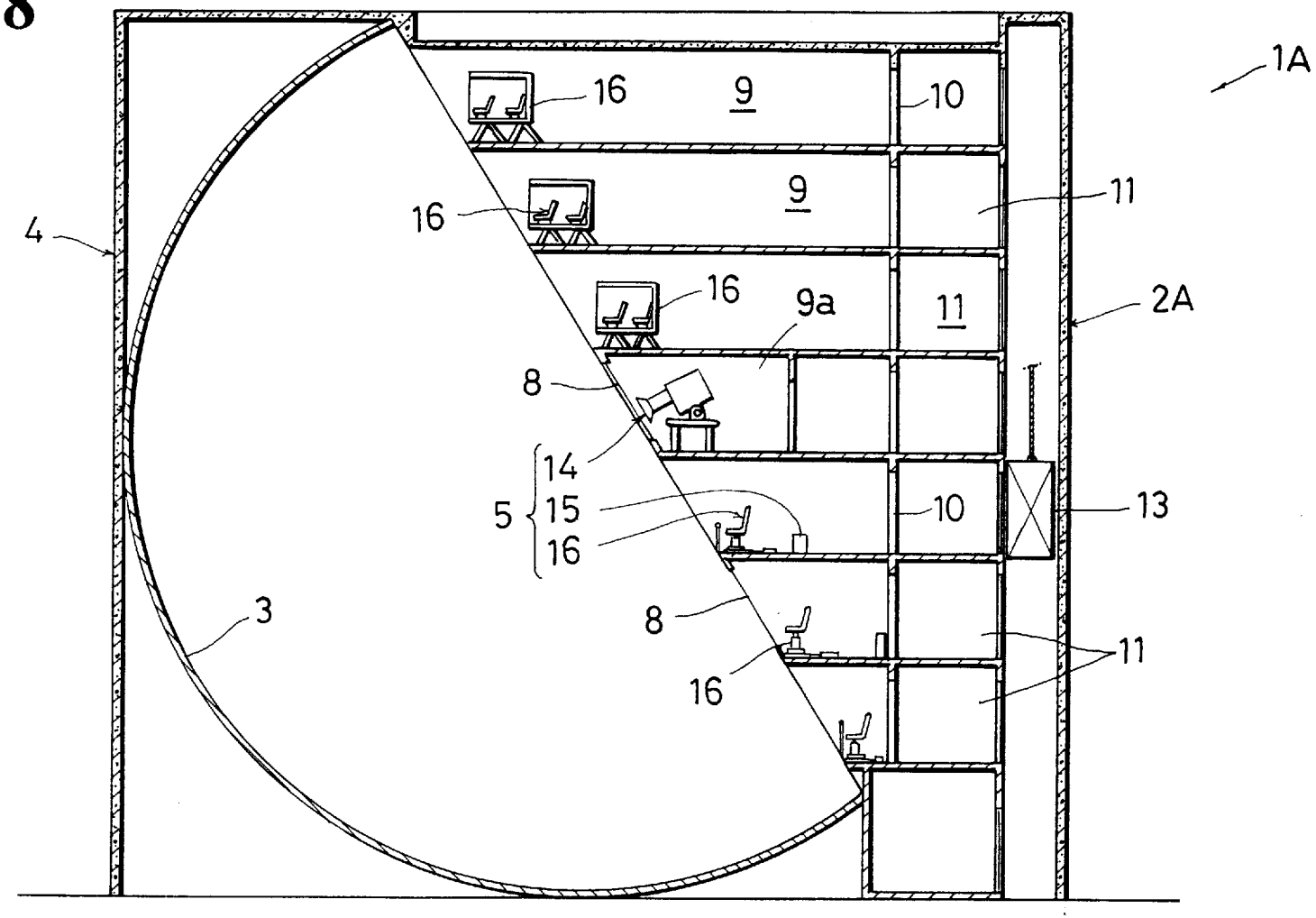
FIG. 8 is a longitudinal-sectional view of the second embodiment of the present invention.
Figure 9:
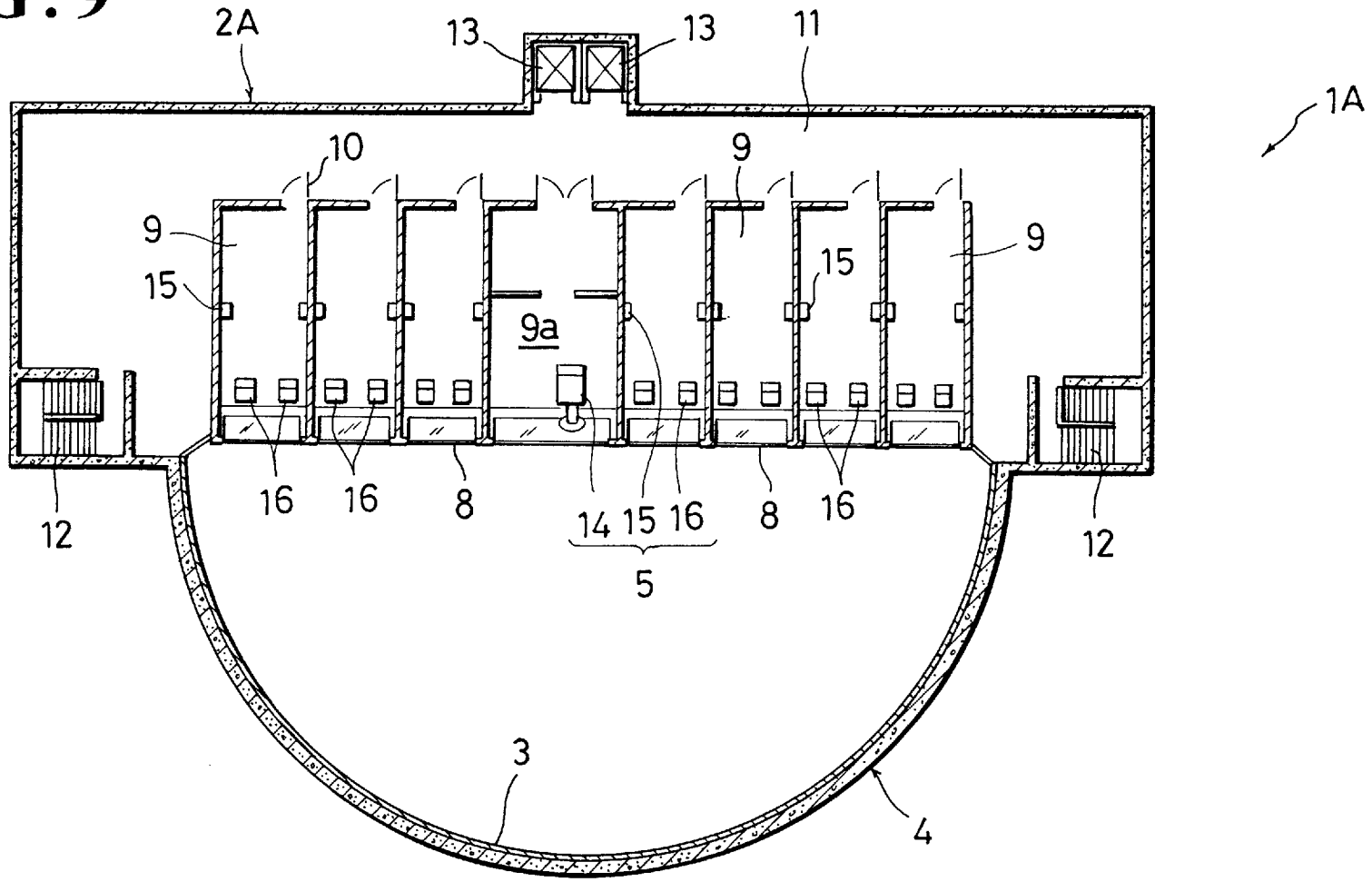
FIG. 9 is a transverse-sectional view of the second embodiment of the present invention.
Figure 10:
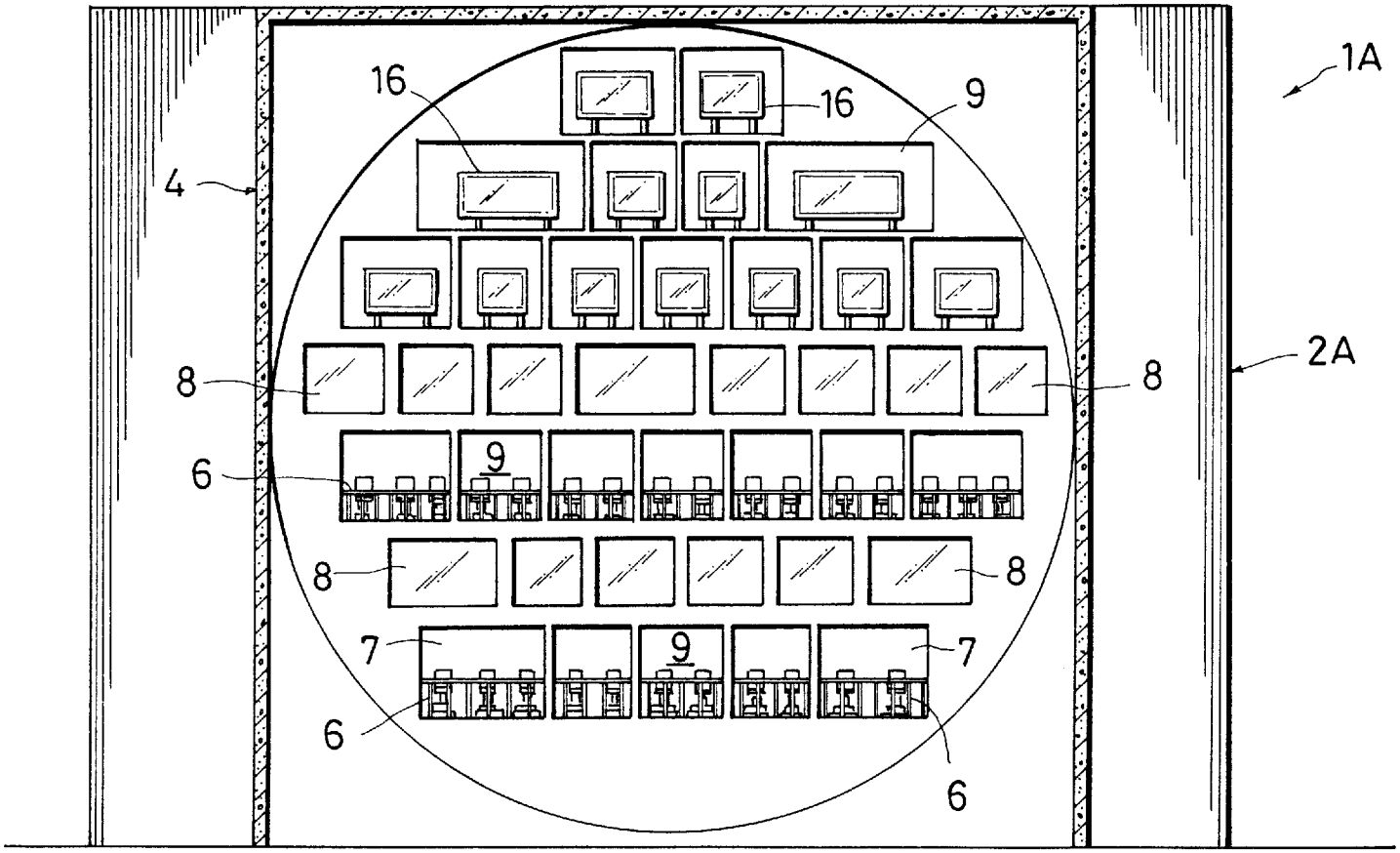
FIG. 10 is a sectional view of the second embodiment of the present invention as seen from the screen.

FIGS. 8 to 10 illustrate a second embodiment of the present invention which is distinguished from the first embodiment by use of compartment building 2A in which compartments 9 form an inverse slope defined by their perspective front ends as seen from top to bottom of the building. The theatre 1A comprising compartment building 2A thus formed according to the second embodiment provides the same effects as of the first embodiment.

In addition, in the same embodiment of the present invention, the floor plate carrying oscillating chairs 16 may be constructed to advance and project beyond the front end of compartment 9 or a cabin installed inside each of compartments 9 may be oscillated with chairs fixed therein, both providing the same effects.

Figure 11:
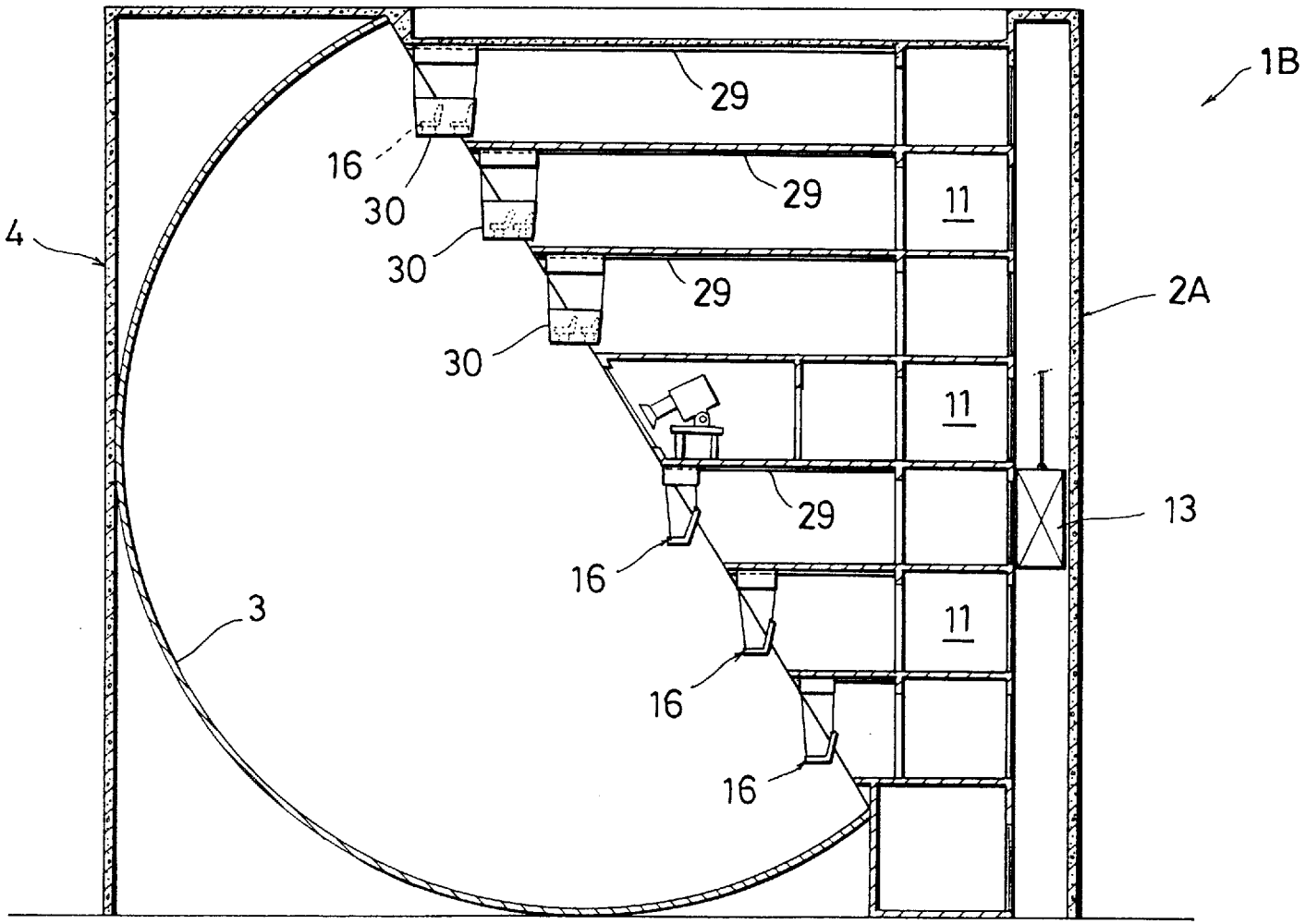
FIG. 11 is a longitudinal-sectional view of the third embodiment of the present invention.
Figure 12:
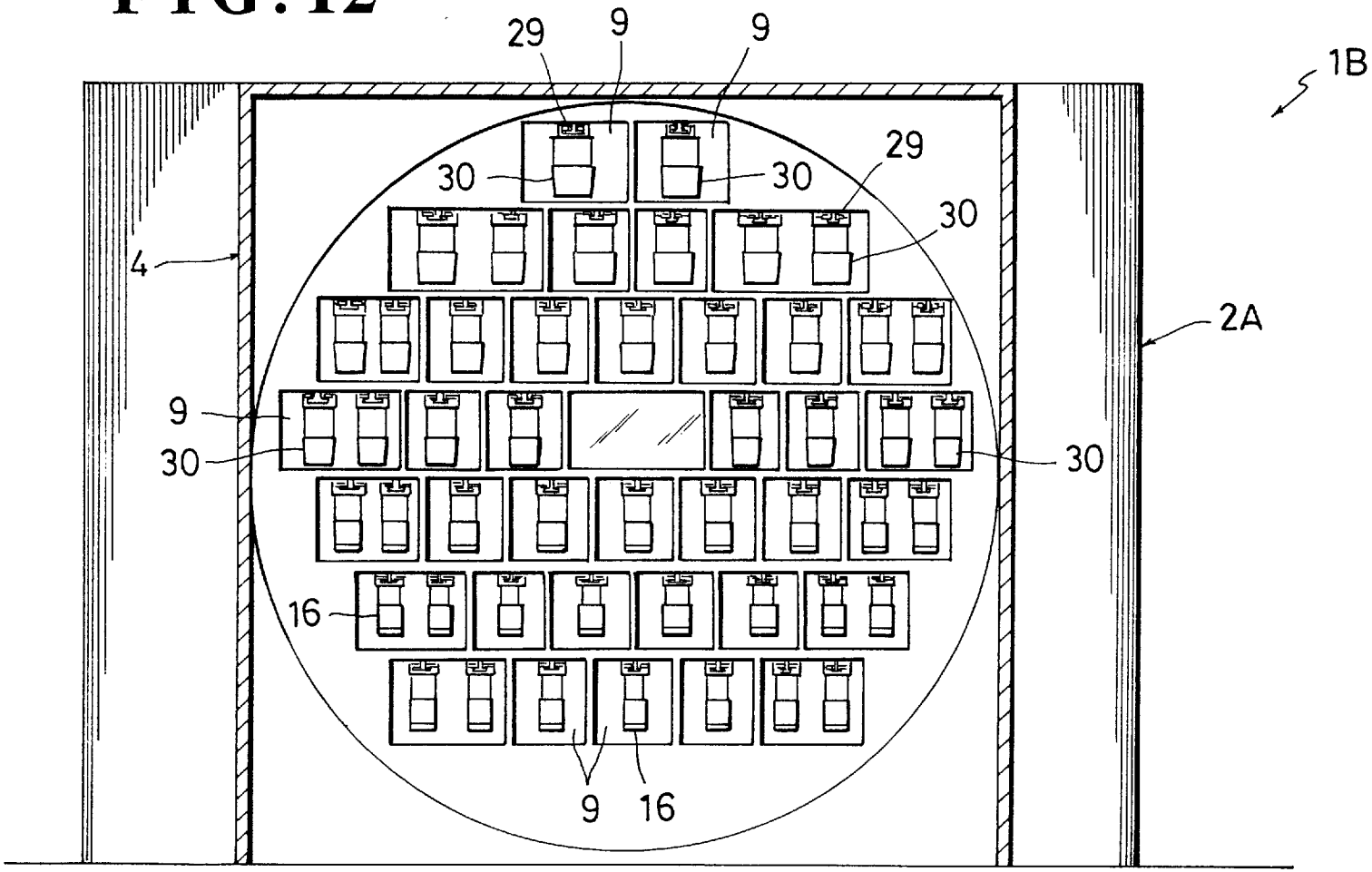
FIG. 12 is a sectional view of the third embodiment of the present invention as seen from the screen.
Figure 13:
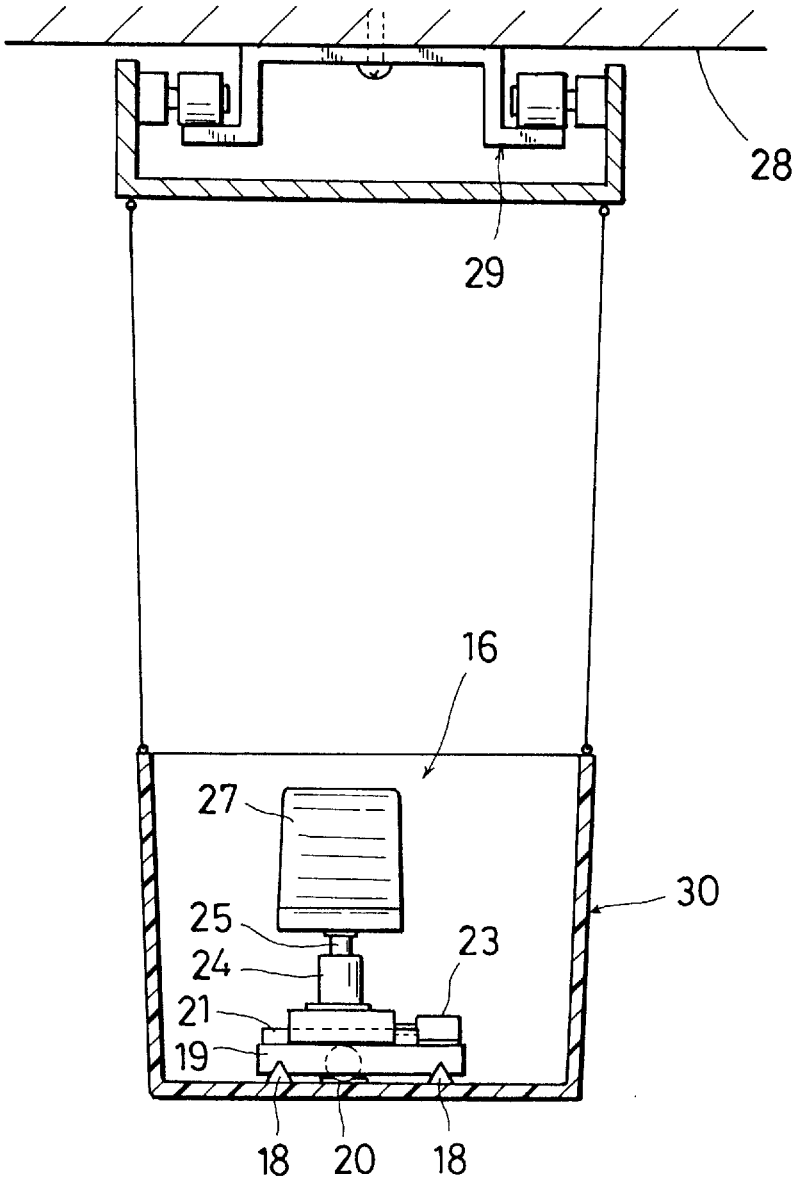
FIG. 13 is an explanatory view of a gondola according to the third embodiment of the present invention.

FIGS. 11 to 13 illustrate a third embodiment of the present invention which is distinguished from the second embodiment by the fact that the oscillating chairs 16 arranged in each of the compartments 9 are installed in a gondola 30 traveling suspended by suspending rails 29 fixed on a ceiling 28. The theatre 1B thus constructed will provide the same effects as of the second embodiment, enabling the gondola 30 to advance and project out of each compartment 9.

In addition, in the same embodiment of the present invention, the suspended gondola 30 may be oscillated by the suspending mechanism or the gondola may be replaced with chairs, which results in the same effect.

Figure 14:
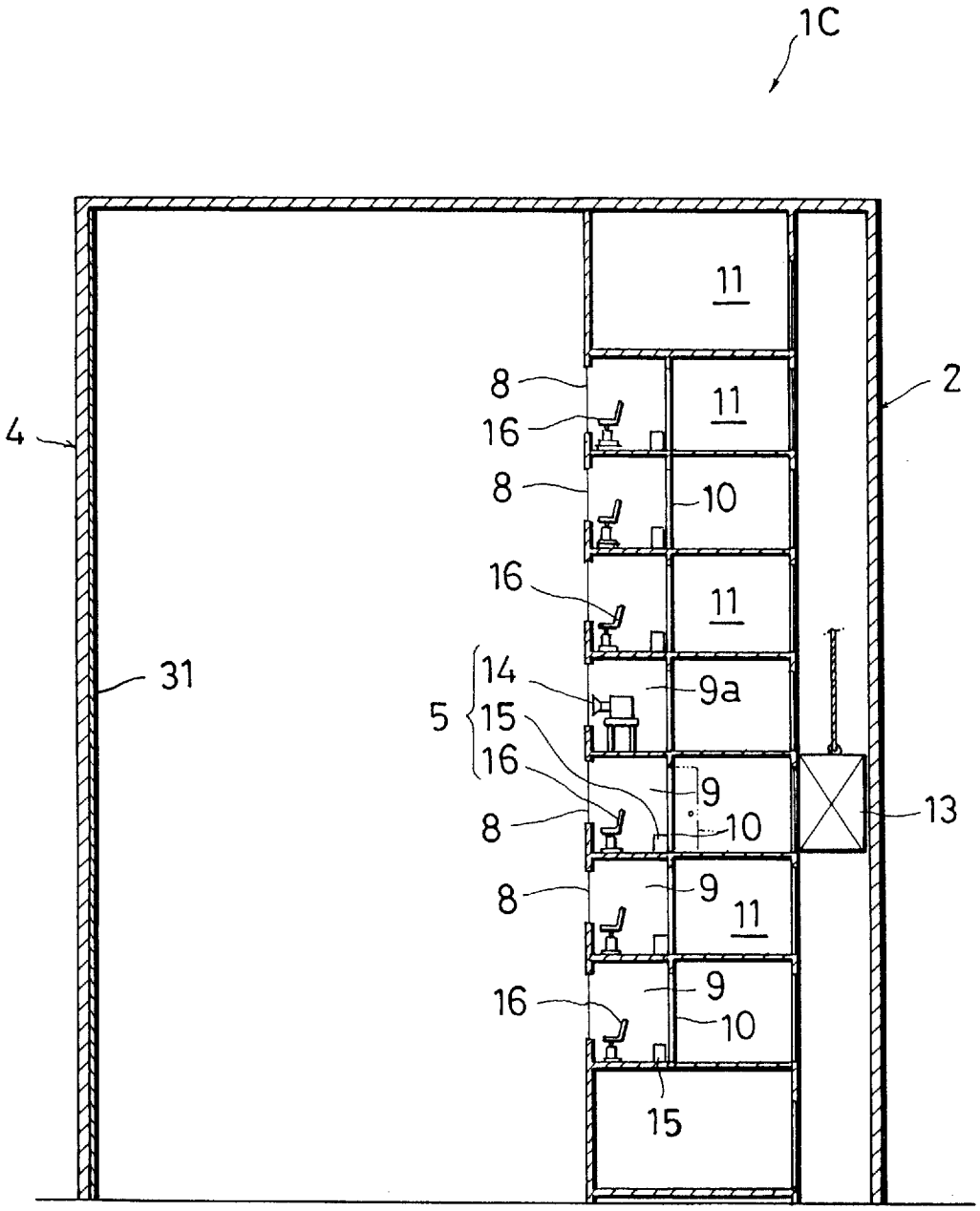
FIG. 14 is a longitudinal-sectional view of the fourth embodiment of the present invention.
Figure 15:
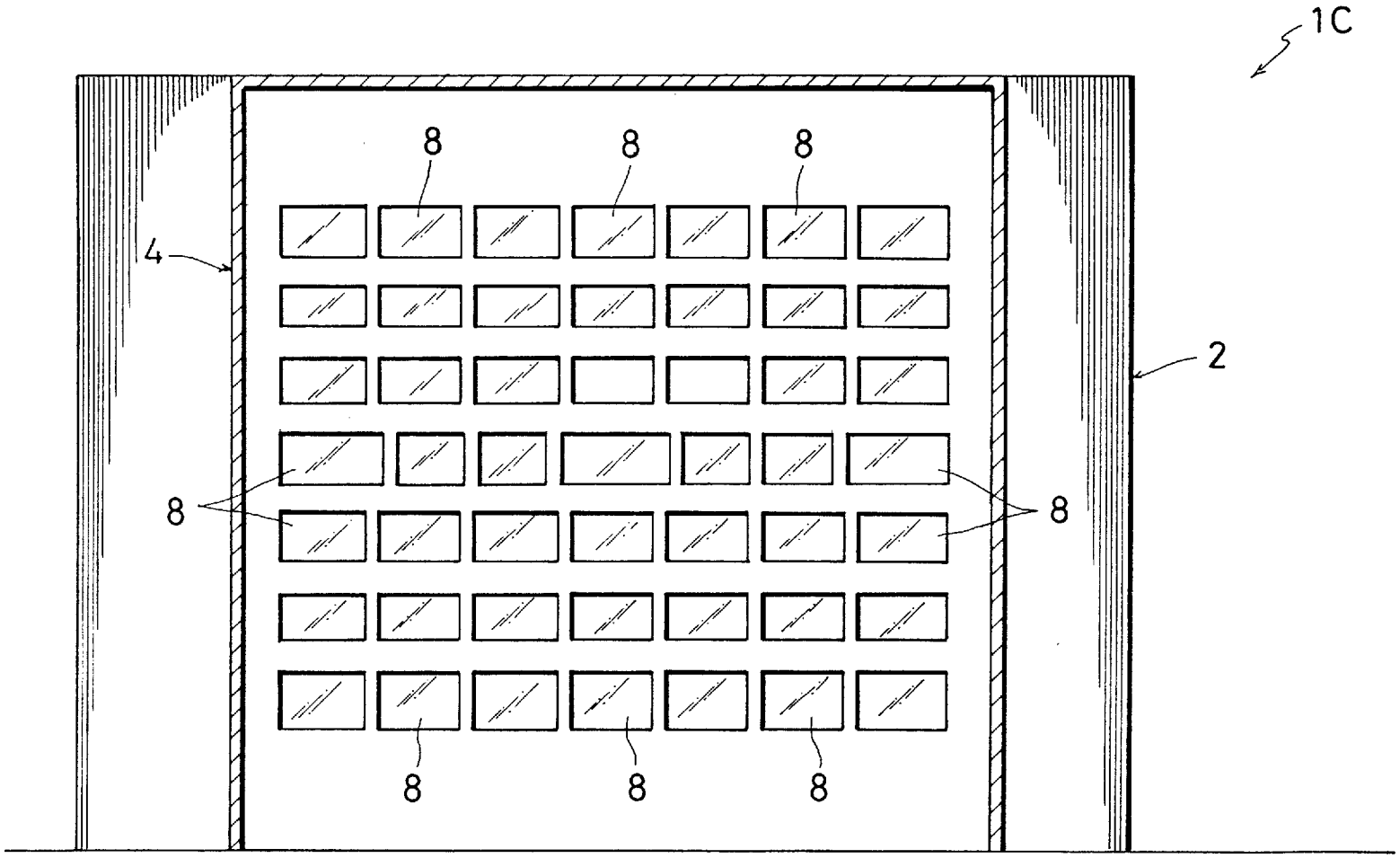
FIG. 15 is a sectional view of the fourth embodiment of the present invention as seen from the screen.

FIGS. 14 and 15 illustrates a fourth embodiment of the present invention which is distinguished from the first embodiment by vertically installing a screen 31 inside the screen housing 4 and providing a window 8 at the front of the compartments 9 to enable the spectator to view the images projected on a screen 31 through the window 8 provided in the compartments 9. The theatre C, thus constructed, provides the same effects as the first embodiment of the present invention.

Figure 16:
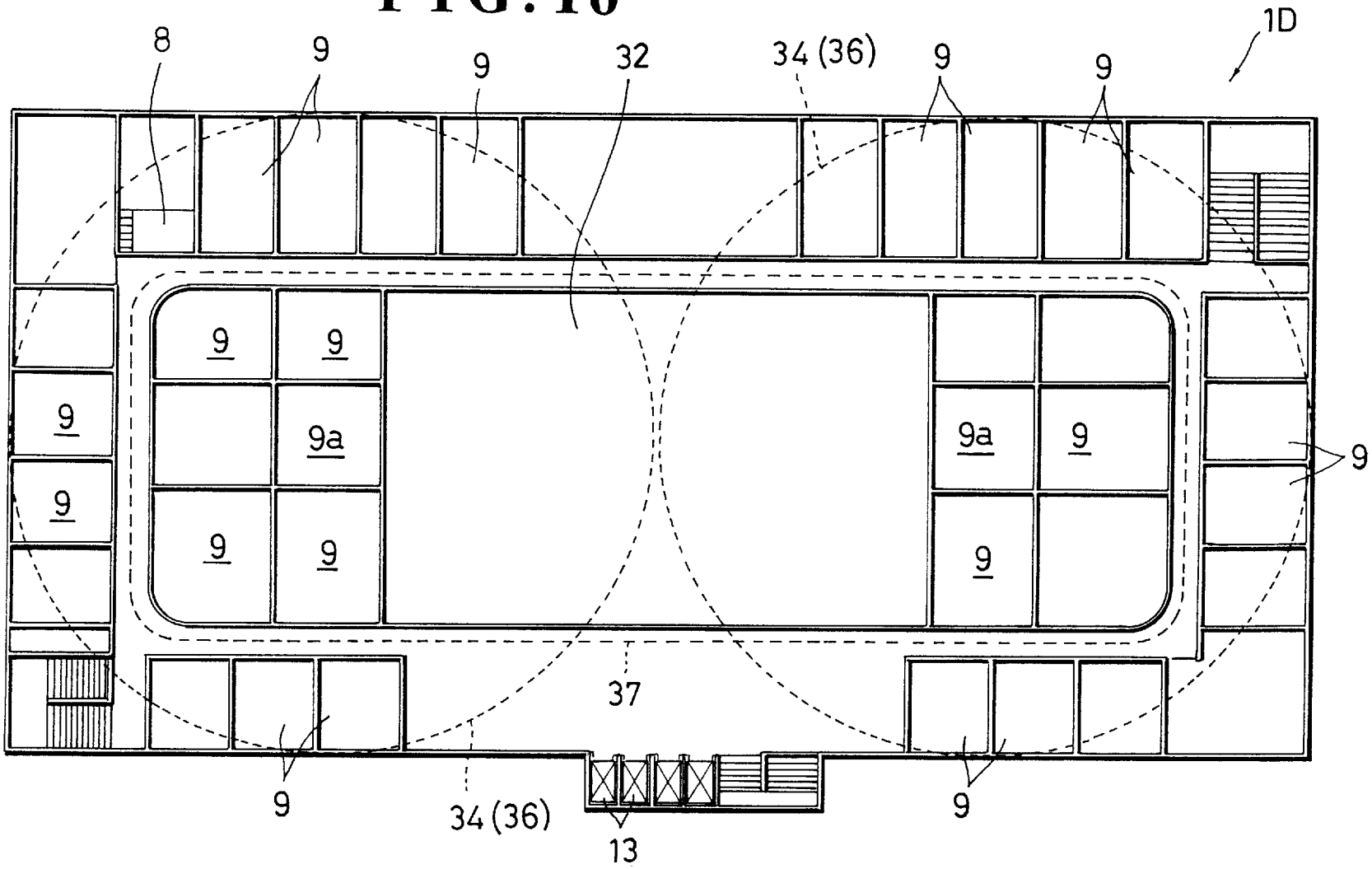
FIG. 16 is an explanatory plan view of the fifth embodiment of the present invention.
Figure 17:
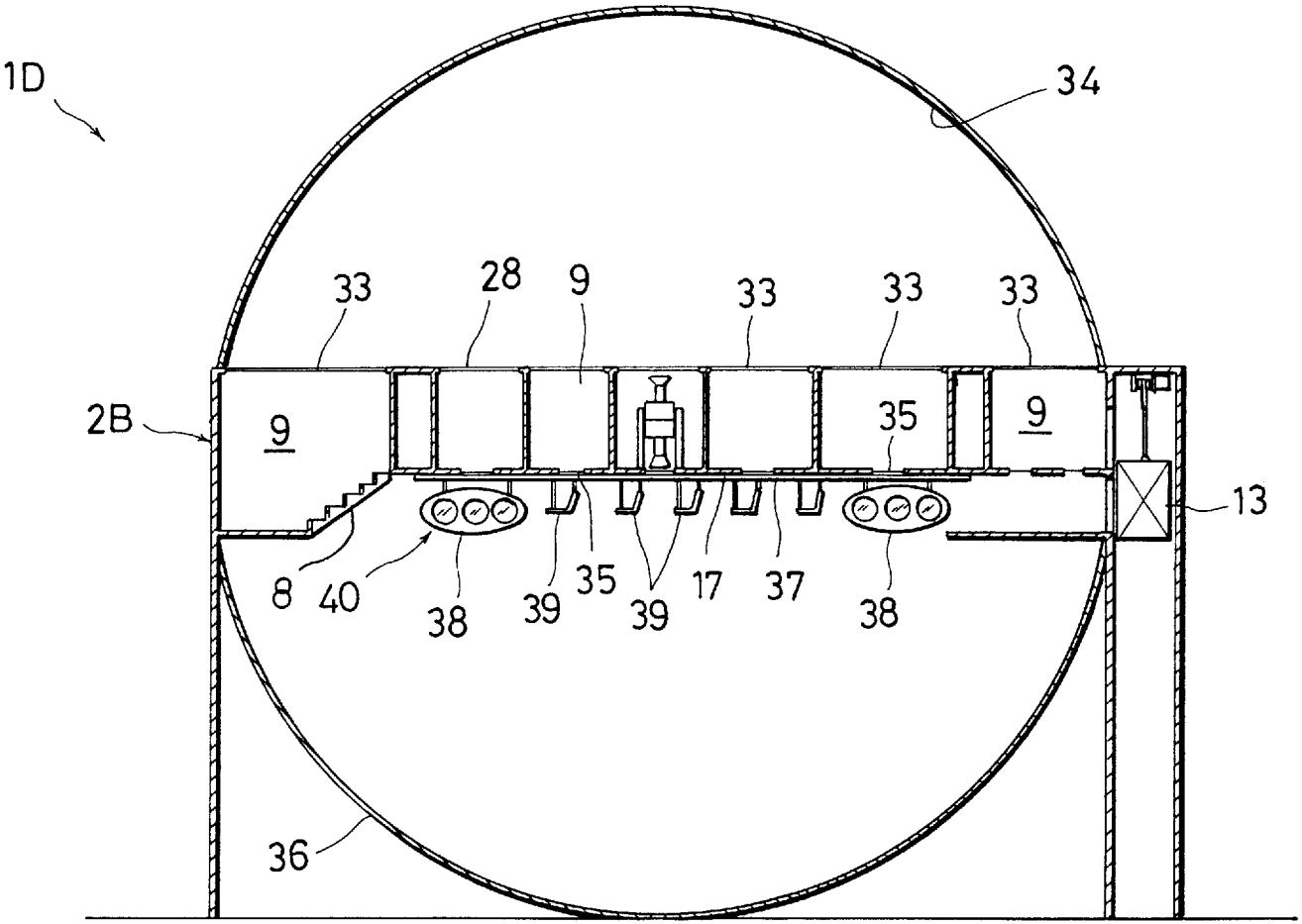
FIG. 17 is a longitudinal-sectional view of the fifth embodiment of the present invention.
Figure 18:
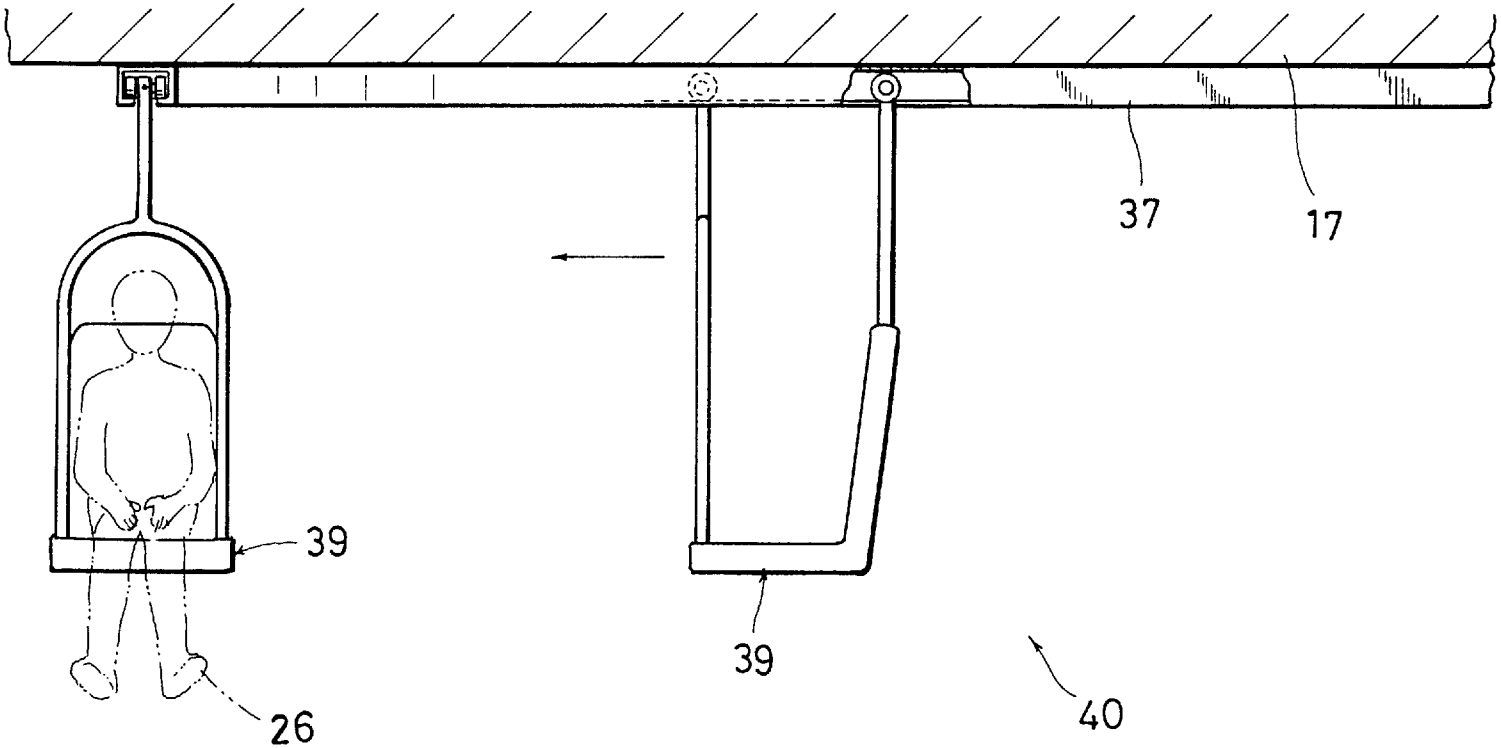
FIG. 18 is an explanatory view of a lift according to the fifth embodiment of the present invention.

FIGS. 16 to 18 illustrate the fifth embodiment of the present invention which is distinguished from the first embodiment by use of a compartment building 2B in which a restaurant hall 32 and a multiplicity of compartments 9 are horizontally arranged, upper dome-shaped screens 34, 34 are arranged above so as to be viewed through skylights 33 opened in ceilings 28 of the multiplicity of compartments 9, lower dome-shaped screens 36, 36 are arranged below so as to be viewed through windows 35 opened in floor plates 17 of the multiplicity of compartments 9, and a lift 40 is provided with a gondola 38 and a suspended chair 39 circulating along rails 37 fixed on the bottom of the floor plate 17 to enable spectators to see the lower dome-shaped screens 36, 36. The theatre 1D, thus constructed, provides the same effects as of the first embodiment of the present invention.

In addition, in the same embodiment of the present invention, one upper dome-shaped screen 34 may be arranged above a multiplicity of compartments 9 and one lower dome-shaped screen 36 or no upper dome-shaped screen may be arranged above the compartments 9.

Figure 19:
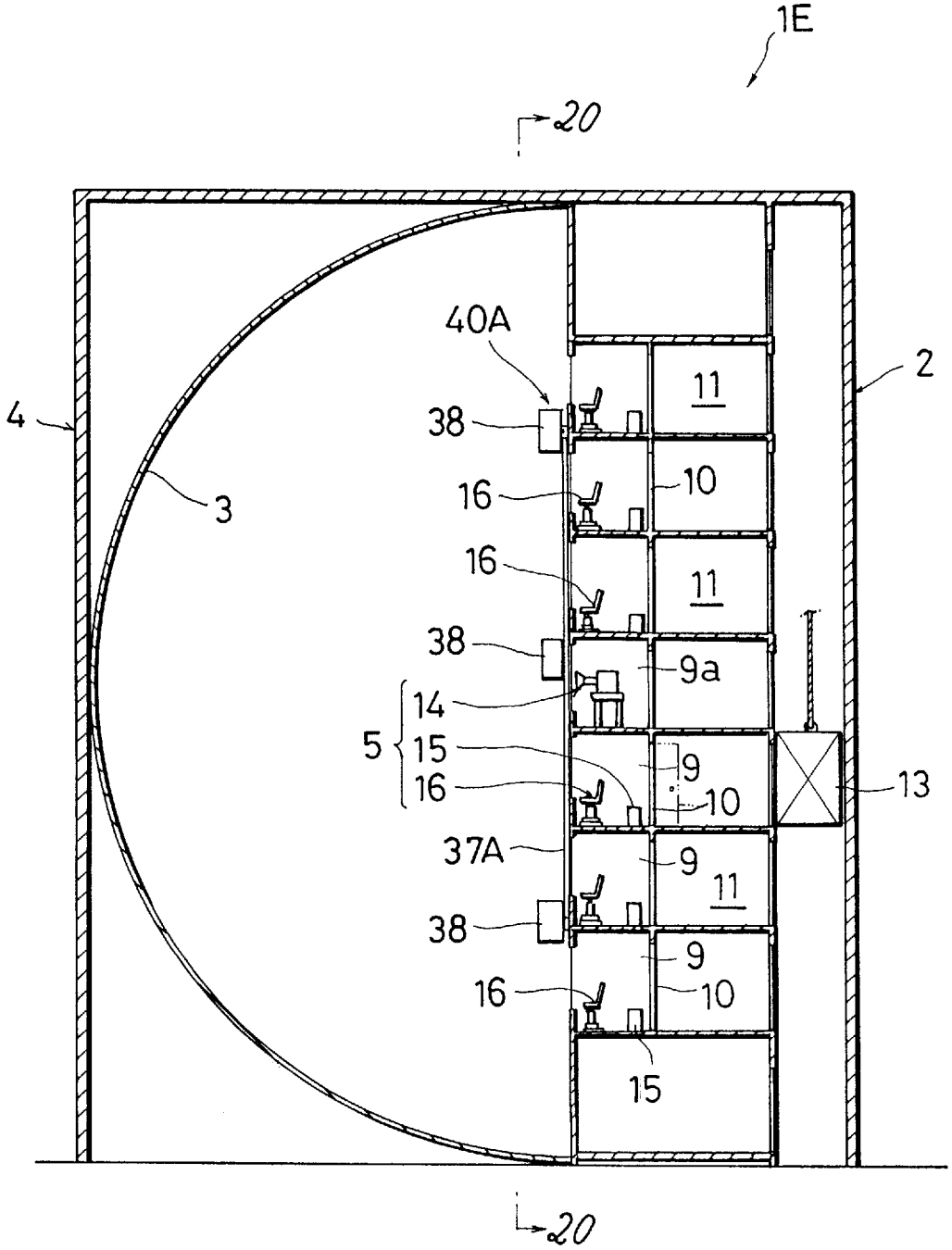
FIG. 19 is a longitudinal-sectional view of the sixth embodiment of the present invention.
Figure 20:
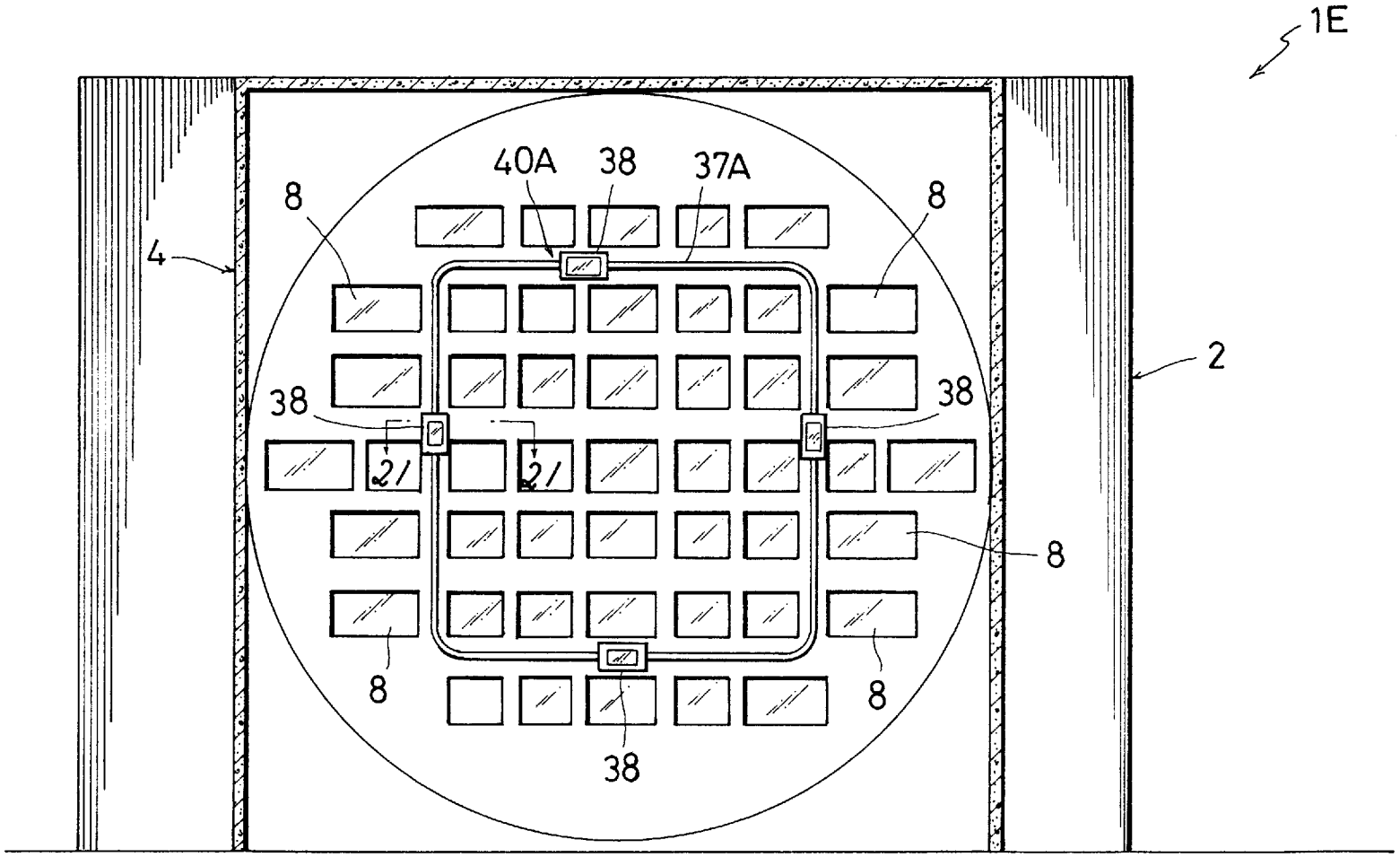
FIG. 20 is a sectional view of the sixth embodiment of the present invention as seen from the screen.
Figure 21:
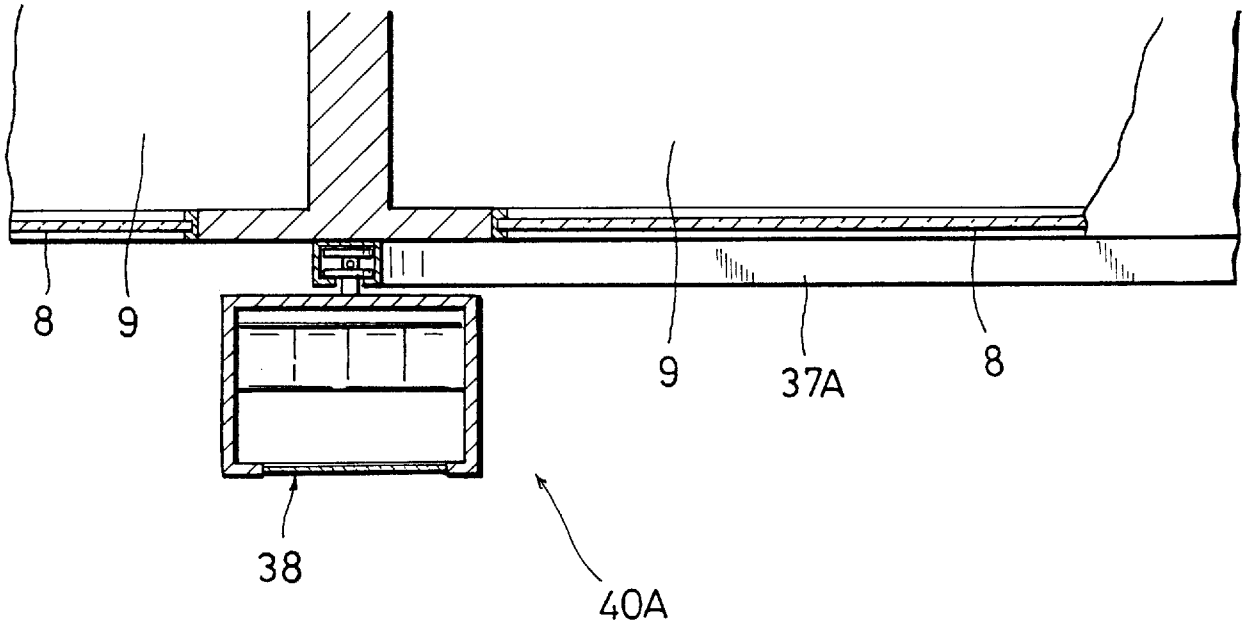
FIG. 21 is an explanatory view of a lift according to the sixth embodiment of the present invention.

FIGS. 19 to 21 illustrate a sixth embodiment of the present invention which is distinguished from the first embodiment by the fact that a lift 40 is provided with a plurality of gondolas 38 moving along rails 37A fixed at the front of the multiplicity of compartments 9 so as not to obstruct the view from inside the compartments 9, enabling spectators to see the dome-shaped screen 3. The theatre 1E, thus constructed, provides the same effects as of the first embodiment of the present invention.

As set forth above, the advantages of the present invention are as follows:

The theatre of the present invention comprises a multiplicity of compartments horizontally and vertically arranged, an image producing system having a screen installed outside the compartments so as to be viewed from inside the compartments, and seats arranged inside the multiplicity of compartments or movably from inside the compartments toward the screen so as to enable spectators to see the screen of the image producing system.

Spectators are no longer disturbed by their neighbors' noises and are no longer prohibited from eating, conversing, etc., for fear of bothering the neighbors.

Resulting from the above construction, the image on the screen is well spaced from the windows of the compartments thus making the image highly realistic and more panoramic.

Resulting from the above construction, the image on the screen can be viewed from the respective compartments under similar conditions.

In conclusion, the theatre utilizing the present invention can provide a fine view to many spectators.

The present invention thus provides a theatre comprising a multiplicity of compartments horizontally arranged and a lower image producing system having a lower screen installed below so as to allow viewing through windows opened on floor plates of said multiplicity of compartments; and a theatre comprising a multiplicity of compartments horizontally arranged, an upper image producing system having an upper screen installed above so as to allow viewing through skylights opened on ceilings of said multiplicity of compartments, a lower image producing system having a lower screen installed below so as to allow viewing through windows opened on floor plates of said multiplicity of compartments, and a lift provided with chairs suspended with gondolas moving along rails fixed on the bottoms of said multiplicity of compartments so as to enable spectators to view said lower screen.

What is claimed is:

1. A theatre comprising:

compartments horizontally and vertically arranged with front end portions defining an inverse slope so that horizontal layers of said compartments overhang horizontal layers of said compartments below;

an image producing system having a screen installed outside said compartments so as to allow viewing from inside said compartments; and seats installed inside said compartments so as to enable spectators seated thereon to view said screen of said image producing system.

2. The theatre according to claim 1, wherein said compartments have windows through which said spectators view said screen.

3. The theatre according to claim 1, wherein said compartments are open rooms allowing spectators to view said screen through openings.

4. The theatre according to claim 1, wherein said seats are on lift mechanisms oscillating in synchronism with an image projected on said screen of said image producing system.

5. The theatre according to claim 1, wherein said screen of said image producing system is concave.

6. The theatre according to claim 1, further comprising oscillating mechanisms for oscillating said seats in synchronization with an image projected on said screen of said image producing system.

7. The theatre according to claim 1, wherein said compartments are closed rooms having windows allowing spectators to view said screen.

8. A theatre comprising:

compartments which are one of horizontally and vertically arranged and horizontally arranged;

an image producing system having a screen installed outside said compartments so as to allow viewing from inside said compartments;

at least one gondola with seats therein permitting spectators seated thereon to view said screen;

oscillating mechanisms for oscillating said at least one gondola in synchronism with an image projected on said screen of said image producing system.

9. The theatre according to claim 8, wherein said screen of said image producing system is concave.

10. The theatre according to claim 8, wherein said compartments have windows through which said spectators view said screen.

11. The theatre according to claim 8, wherein said compartments are open rooms allowing spectators to view said screen through openings.

12. The theatre according to claim 8, wherein said compartments are closed rooms having windows allowing spectators to view said screen.

* * * * *